US011950697B2

(12) United States Patent
Li et al.

(10) Patent No.: US 11,950,697 B2
(45) Date of Patent: Apr. 9, 2024

(54) HEIGHT-ADJUSTABLE TABLE

(71) Applicant: DEWERTOKIN TECHNOLOGY GROUP CO., LTD., Jiaxing (CN)

(72) Inventors: Long Li, Jiaxing (CN); Zhibin Ao, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 0 days.

(21) Appl. No.: 17/897,260

(22) Filed: Aug. 29, 2022

(65) Prior Publication Data

US 2022/0408911 A1 Dec. 29, 2022

Related U.S. Application Data

(63) Continuation of application No. PCT/CN2020/137520, filed on Dec. 18, 2020.

(30) Foreign Application Priority Data

Mar. 25, 2020 (CN) ..... 202020400374.3

(51) Int. Cl.
*A47B 9/00* (2006.01)
*A47B 13/02* (2006.01)

(52) U.S. Cl.
CPC ..... *A47B 9/00* (2013.01); *A47B 13/02* (2013.01)

(58) Field of Classification Search
CPC ... A47B 9/00; A47B 13/02; A47B 2200/0056; A47B 2200/0057
See application file for complete search history.

(56) References Cited

U.S. PATENT DOCUMENTS

| | | | | |
|---|---|---|---|---|
| 6,135,032 | A | 10/2000 | Ko | |
| 11,730,261 | B1 * | 8/2023 | Lin | A47B 13/02 108/59 |
| 2017/0303679 | A1 * | 10/2017 | Tseng | A47B 9/04 |
| 2022/0359785 | A1 * | 11/2022 | Chu | H01L 33/20 |
| 2022/0378194 | A1 * | 12/2022 | Lin | A47B 21/06 |
| 2022/0400846 | A1 * | 12/2022 | Lin | A47B 9/04 |
| 2023/0210254 | A1 * | 7/2023 | Lin | A47B 3/08 108/20 |

FOREIGN PATENT DOCUMENTS

| | | |
|---|---|---|
| CN | 203353889 U | 12/2013 |
| CN | 203735710 U | 7/2014 |

(Continued)

OTHER PUBLICATIONS

International Search Report Cited in PCT/CN2022/137520, dated Mar. 8, 2021; 5 Pages.

(Continued)

*Primary Examiner* — Daniel J Rohrhoff
(74) *Attorney, Agent, or Firm* — Cooper Legal Group, LLC

(57) ABSTRACT

The present application relates to a height-adjustable table including a table plate. a table leg is fixedly connected to a side surface of the table plate, two brackets are arranged oppositely on the side surface of the table plate, and a retaining plate is fixedly connected to opposite inner sides of the two brackets, respectively. A control box is provided, a retaining clip is fixedly connected to the control box, and the retaining clip is detachably connected to the retaining plate.

15 Claims, 4 Drawing Sheets

(56) References Cited

FOREIGN PATENT DOCUMENTS

| | | | | |
|---|---|---|---|---|
| CN | 205446315 | U | | 8/2016 |
| CN | 206548109 | U | * | 10/2017 |
| CN | 206548109 | U | | 10/2017 |
| CN | 206948764 | U | | 1/2018 |
| CN | 208354930 | U | * | 1/2019 |
| CN | 208354930 | U | | 1/2019 |
| CN | 209327817 | U | | 8/2019 |
| CN | 209359908 | U | | 9/2019 |
| CN | 209660833 | U | | 11/2019 |
| CN | 209711979 | U | | 12/2019 |
| CN | 209732944 | U | | 12/2019 |
| CN | 212165233 | U | | 12/2020 |
| CN | 112932062 | A | * | 6/2021 |
| JP | 2005040212 | A | | 2/2005 |

OTHER PUBLICATIONS

European Search Report to Corresponding Application No. EP20927879, dated Jul. 11, 2023; 4 Pages.

* cited by examiner

A

HEIGHT-ADJUSTABLE TABLE

CROSS-REFERENCE TO RELATED APPLICATION

This application is a continuation of PCT application serial no. PCT/CN2020/137520, filed on Dec. 18, 2020, which claims the priority and benefit of Chinese patent application serial no. 202020400374.3, filed on Mar. 25, 2020. The entirety of PCT application serial no. PCT/CN2020/137520 and Chinese patent application serial no. 202020400374.3 are hereby incorporated by reference herein and made a part of this specification.

TECHNICAL FIELD

The present application relates to a technical field of a height-adjustable table, and particularly to a height-adjustable table.

BACKGROUND ART

With the progress of science and technology, in order to meet different requirements of users, the use of the height-adjustable table is becoming more and more common. When a control box of the height-adjustable table is installed to a table plate, the control box is fixedly connected to the table plate usually by a screw. When the control box needs to be installed or removed, a tool is needed to remove the screw. Therefore, the operation is inconvenient and the installation efficiency is low.

A known retaining clip structure for fixing the control box of the height-adjustable table has a base plate configured for being matched with the control box of the height-adjustable table and supporting the control box of the height-adjustable table upward. Two ends of the base plate are separately provided with a wing plate configured to be matched with two support beams of the height-adjustable table and closely attached to the surfaces of the two support beams. Ends of each of the wing plates are provided with a folded edge configured to be snapped into a gap between a table plate and support beams of the height-adjustable table. By the retaining clip structure, the control box of the height-adjustable table can be more conveniently installed to the bottom surface of the table plate of the height-adjustable table and positioned between the two support beams of the height-adjustable table, and a screw and a professional tool are not required during the whole installing process.

However, during a using process of the retaining clip structure, the control box is putted on the base plate, and then the base plate is lifted and the folded edges of the two ends of the base plate are inserted into a gap between the table plate and the support beams. The base plate on which the control box is placed is suspended only by a friction between the folded edges, the table plate and the support beams. If the weight of the control box is greater than the friction, the control box and the base plate will easily fall off between the table plate and the support beams, thereby resulting insufficient connection.

SUMMARY

In view of the above problems, the present application provides a height-adjustable table, which has an advantage that a control box can be firmly connected to the table plate.

The present application adopts the following technical solution: a height-adjustable table, including a table plate, in which a table leg is fixedly connected to a side surface of the table plate; two brackets are arranged oppositely on the side surface of the table plate, and a retaining plate is fixedly connected to opposite inner sides of the two brackets, respectively; a control box is provided, a retaining clip is fixedly connected to the control box, and the retaining clip is detachably connected to the retaining plate.

In above technical solution, when the control box need to be installed to the table plate, firstly the retaining clip is aligned with the retaining plate and moved towards the edge of the retaining plate, so that the retaining plate can be clamped to the retaining clip, and further the control box can be stably and firmly connected to a lower surface of the table plate.

In an embodiment, the retaining clip is formed with a receiving recess for clamping the retaining plate, and the retaining clip is configured as L-shaped, one end of the retaining clip is fixedly connected to a side of the control box away from its front, and the other end is a free end.

In above technical solution, when the control box need to be installed to the table plate, the free end of the retaining clip is aligned with the retaining plate and moved towards the edge of the retaining plate, so that the edge of the retaining plate is inserted into the receiving recess.

In an embodiment, a limiting plate is fixedly connected to a upper surface of the control box, and a first sidewall of the limiting plate is attached to an edge of the retaining plate.

In above technical solution, when the receiving recess is moved towards the edge of the retaining plate, the edge of the retaining plate can be gradually inserted into the receiving recess, the first sidewall of the limiting plate is firstly attached to the edge of the retaining plate to prevent the edge of the retaining plate from continuing to move towards the sidewall of the receiving recess, at the same time, there is a gap between the sidewall of the receiving recess and the edge of retaining plate to prevent the sidewall of the receiving recess from being damaged due to impact.

In an embodiment, a reinforcing block is fixedly connected to the control box, and a sidewall of the reinforcing block is fixedly connected to a second sidewall of the limiting plate away from the retaining plate.

In above technical solution, the limiting plate can be more stably abutted against the retaining plate, thereby preventing the sidewall of the receiving recess and the edge of the retaining plate from colliding and being damaged.

In an embodiment, a side of the retaining plate close to the receiving recess is formed with a groove, an end of the retaining clip is formed with a snap portion configured to be snapped into the groove. In a further embodiment, the snap portion is configured as a semicircular arc shape.

In above technical solution, the retaining clip can be more stably clamped to the retaining plate, when the control box need to be installed to the table plate, the retaining clip can be aligned with the retaining plate and be moved to a direction of the retaining plate by the operator. Because the snap portion is configured as a semicircular arc shape, the snap portion can be pushed to an upper surface of the retaining plate more smoothly by the operator; and further the snap portion can be snapped into the groove to finish the installing of the control box. The operation is convenient.

In an embodiment, a buffer portion is fixedly connected to the first sidewall of the limiting plate towards the retaining plate. In a further embodiment, the buffer portion is made of rubber.

In above technical solution, when the operator moves the control box, so that the snap portion is snapped into the groove, it can be prevented that the retaining plate hits the limiting plate if the operator does not control the force well. The limiting plate will be damaged after a long time. The buffer portion can play a buffering role to reduce the impact of the retaining plate on the limiting plate, thereby prolonging the service life of the limiting plate.

In an embodiment, a reinforcing rib is fixedly connected to a side of the retaining clip away from the retaining plate.

In above technical solution, in order to prevent a strength of the retaining clip from deteriorating due to high using frequency, a reinforcing rib is welded to a sidewall of the retaining clip, thereby effectively strengthening the strength of the retaining clip and prolonging the service life of the retaining clip.

In an embodiment, a side of the free end of the retaining clip towards the retaining plate is configured as an inclined plane for guiding the retaining clip to be snapped into the retaining plate.

In above technical solution, when the operator needs to push the snap portion to the upper surface of the retaining plate, the inclined plane can reduce the resistance of the retaining plate to the retaining clip, so that the snap portion can be pushed to the upper surface of the retaining plate more smoothly by the operator, and then the snap portion can be snapped into the groove.

In an embodiment, a rectangular frame is formed inside the retaining plate, a number of the retaining clip is configured as at least two, and an inner edge and an outer edge of the retaining plate are clamped to the retaining clip, respectively.

In above technical solution, a number of the retaining clip is configured as two, an inner edge and an outer edge of the retaining plate are clamped to the retaining clip, respectively, and an opening direction for the receiving recess of the retaining clip is same, so that the control box can be fixedly connected to the retaining plate more stably.

In an embodiment, a connecting plate is fixedly connected between the two brackets, and the connecting plate is formed with a screw hole for screws to pass through and be fixed to the table plate.

In above technical solution, the operator can pass the screw through the screw hole, then fix the screw to the table plate, and further fix the bracket to the lower surface of the table plate, so that when the table plate is damaged, the screw can be removed from the table plate, and further the bracket can be smoothly removed from the table plate by the operator, and the bracket can be recycled and the resources can be saved.

In summary, the present application has at least one beneficial effect as follows: When the control box need to be installed to the table plate, firstly the retaining clip is aligned with the retaining plate and moved towards the edge of the retaining plate, so that the retaining clip can be clamped to the retaining plate, and further the control box can be stably and firmly connected to the lower surface of the table plate.

When the control box need to be installed to the table plate, the operator can align the retaining clip with the retaining plate and move to a direction of the retaining plate. Because the snap portion is semicircular arc shape, the operator can more smoothly push the snap portion to an upper surface of the retaining plate, and further the snap portion can be snapped into the groove to finish a installing of the control box. The operation is convenient.

DETAILED DESCRIPTION

The present application is further described in detail below in combination with the Figures.

Figure 1:
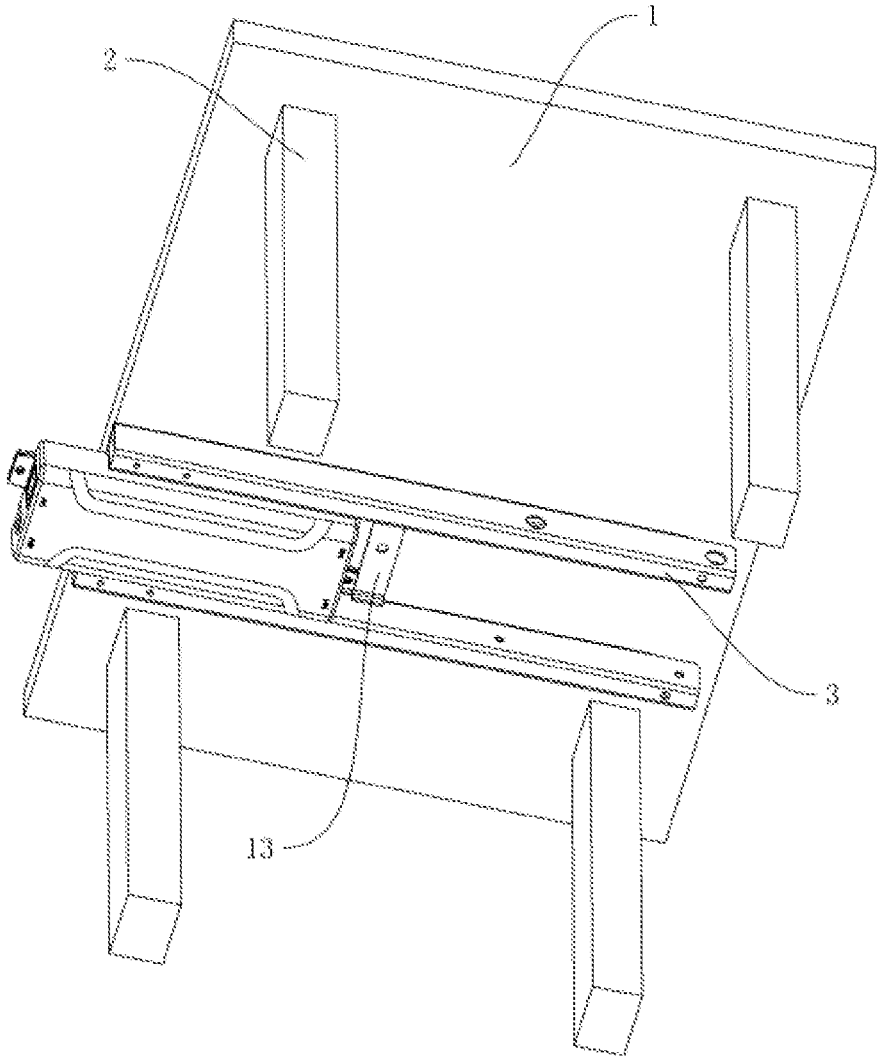
FIG. 1 is an overall structure schematic diagram of a installing structure in use state according to an embodiment of the present application.
Figure 2:
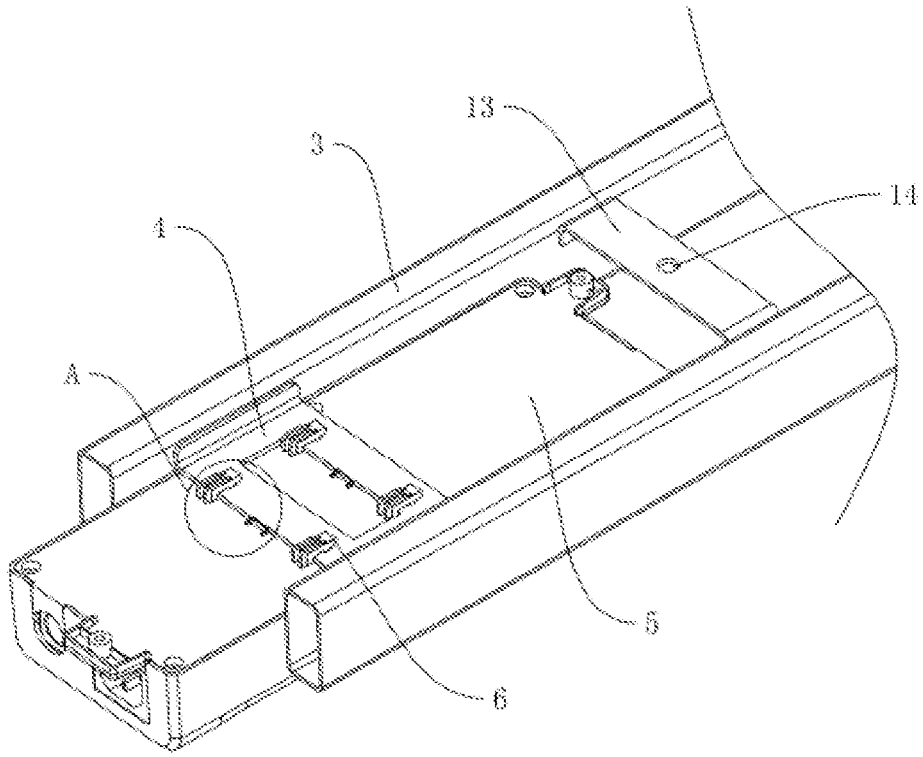
FIG. 2 is a partial structure schematic diagram of a installing structure according to an embodiment of the present application.

Referring to FIGS. 1-2, a height-adjustable table disclosed in the present application includes a table plate 1. In some embodiments, the table plate 1 is configured as rectangle shape. Table legs 2 are fixedly connected to four corners at a lower surface of the table plate 1, respectively, and the connection way can be welding. Two brackets 3 arranged horizontally and oppositely are connected to the lower surface of the table plate 1. A retaining plate 4 arranged horizontally is fixedly connected to opposite inner sides of the two brackets 3, respectively. A longitudinal section of the retaining plate 4 is configured as U-shaped, and two ends of the retaining plate 4 are flushed with an upper surface of the brackets 3, so that there is a space between the upper surface of the retaining plate 4 and the lower surface of the table plate 1. A control box 5 arranged horizontally is clamped in the space between the retaining plate 4 and the table plate 1, and the control box 5 is configured as rectangle shape. An electric control device for driving the height-adjustable table to rise and fall is installed inside the control box 5, and a retaining clip 6 arranged horizontally is fixed at a lower surface of the control box 5 along its width direction. A lower surface of the retaining clip 6 is formed with a receiving recess 61 for clamping the retaining plate 4. In some embodiments, the retaining clip 6 is configured as L-shaped; one end of the retaining clip 6 is fixedly connected to a side of the control box 5 away from its front, and the other end is a free end, so that the retaining clip 6 can be detachably connected to the retaining plate 4. In some embodiments, in order to install the control box 5 to the retaining plate 4 more stably, a rectangular frame is formed inside the retaining plate 4; a number of the retaining clips 6 is configured as at least two, such as four; and four ends of the retaining plate 4 are clamped to the four retaining clips 6. Opening directions of the receiving recess 61 of the retaining clip 6 are same, in which an outer edge of the retaining plate 4 is clamped to two retaining clips 6, and an inner edge of the retaining plate 4 is clamped to the other two retaining clips 6, thereby the control box 5 can be fixedly connected to the retaining plate 4 more stably.

When the control box 5 needs to be installed to the table plate 1, firstly the retaining clip 6 is aligned with the retaining plate 4 and moved towards an edge of the retaining plate 4. The rectangular frame is formed inside the retaining plate 4, and a width of the rectangular frame inside the retaining plate 4 is greater than a length of the retaining clip 6, so that the four ends of the retaining plate 4 can be clamped to all the four retaining clips 6; further the control box 5 can be fixed stably and firmly to the lower surface of the table plate 1; and the installing operation is convenient.

Figure 3:
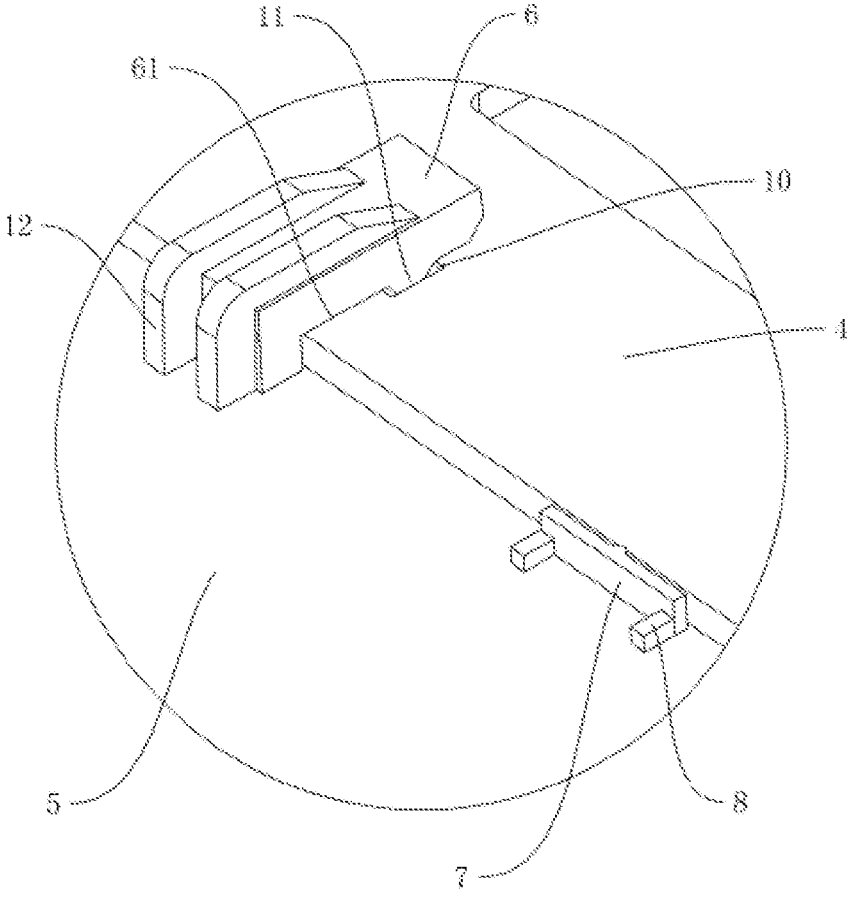
FIG. 3 is a partially enlarged schematic diagram of A portion in FIG. 2.

Referring to FIG. 3, when the retaining plate 4 is clamped to the retaining clip 6, a sidewall of the receiving recess 61 will collide with the edge of the retaining plate 4. In order to prevent the sidewall of the receiving recess 61 from being worn and damaged due to impact, a vertical limiting plate 7 is fixed to a side of the control box 5 facing the retaining plate 4. The limiting plate 7 is configured as rectangle shape and its long side is arranged horizontally, and the limiting plate 7 is configured as parallel to the sidewall of the retaining plate 4, so that a contact area between the limiting plate 7 and the retaining plate 4 can be increased. When the receiving recess 61 is moved towards the edge of the retaining plate 4 and the edge of the retaining plate 4 is gradually inserted into the receiving recess 61, a first sidewall of the limiting plate 7 is attached to the edge of the retaining plate 4, so that the edge of the retaining plate 4 cannot move towards the sidewall of the receiving recess 61, at this time, there is a gap between the sidewall of the receiving recess 61 and the edge of the retaining plate 4, so as to prevent the sidewall of the receiving recess 61 from colliding with the edge of the retaining plate 4.

Referring to FIG. 3, in order to make the limiting plate 7 be attached to the retaining plate 4 more stably, a reinforcing block 8 is fixed to the control box 5. In some embodiments, the reinforcing block 8 is configured as two, which are connected to two ends of the limiting plate 7 respectively, such as by welding, and located at one side of the limiting plate 7 away from the retaining plate 4, so that the limiting plate 7 is more stable.

Referring to FIG. 3, in order to make the retaining plate 4 be clamped to the retaining clip 6 more stably, a sidewall of the retaining plate 4 facing the receiving recess 61 is formed with a groove 10. A lower surface of end of retaining clip 6 is integrally formed with a snap portion 11 configured to be snapped into the groove 10, and the snap portion 11 is configured as a semicircular arc shape, so that the snap portion 11 can smoothly slide into the groove 10, further the snap portion 11 can be snapped into the groove 10. When the control box 5 is installed to the table plate 1, the retaining clip 6 can be aligned with the retaining plate 4 and moved towards the direction of the retaining plate 4 by the operator. Because the snap portion 11 is configured as a fillet structure, the operator can more smoothly push the snap portion 11 to the upper surface of the retaining plate 4; and further the snap portion 11 can be snapped into the groove 10 to finish the installing of the control box 5. The operation is convenient.

Figure 4:
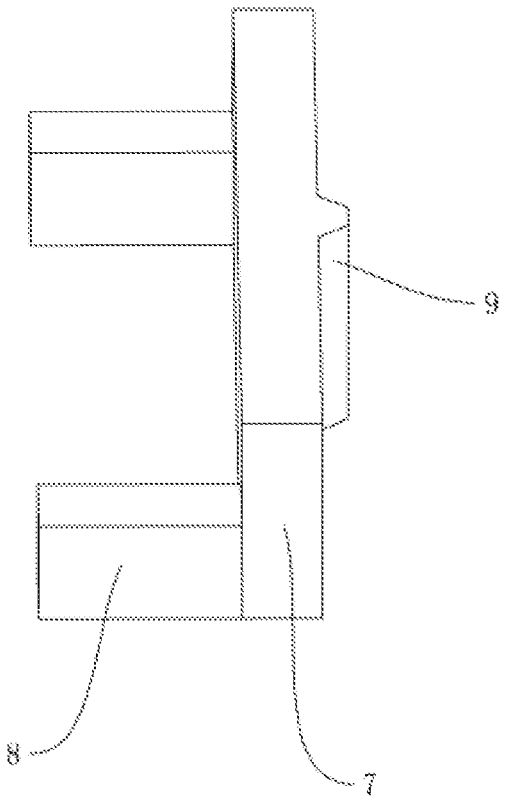
FIG. 4 is an overall structure schematic diagram of a limiting plate according to an embodiment of the present application.

Referring to FIGS. 3-4, a buffer portion 9 is adhered to a sidewall of the limiting plate 7 towards the retaining plate 4 with glue to protect the limiting plate 7 from damage. For example, when the snap portion 11 is snapped into the groove 10 by moving the control box 5 by an operator, if the force cannot be properly controlled, the retaining plate 4 may hit and damage the limiting plate 7. A cross section of the buffer portion 9 is configured as trapezoidal, and the buffer portion 9 is arranged in the center of the limiting plate 7. When the snap portion 11 is snapped into the groove 10, the buffer portion 9 can abut against the edge of the retaining plate 4. In some embodiments, the buffer portion 9 is made of rubber, so that the buffer portion 9 can play a buffering role, and reduce the possibility of the retaining plate 4 colliding with the limiting plate 7, thereby prolonging the service life of the limiting plate 7.

Referring to FIG. 3, in order to increase the strength of the retaining clip 6 and prevent the strength of the retaining clip 6 from deteriorating due to high use frequency, a reinforcing rib 12 is fixed to a sidewall of the retaining clip 6, and a fixing way may be welding. In some embodiments, two reinforcing rib 12 are provided, which are respectively located at both ends of the retaining clip 6 along its width direction. An end of the reinforcing rib 12 is welded to the control box 5, thereby effectively increasing the strength of the retaining clip 6 and prolonging the service life of the retaining clip 6.

Referring to FIG. 3, in order to push the snap portion 11 to the upper surface of the retaining plate 4 more smoothly by the operator, a side of the free end of the retaining clip 6 towards the retaining plate 4 is configured as an inclined plane to play a guiding role. When the snap portion 11 need to be pushed to the upper surface of the retaining plate 4 by the operator, the inclined plane can reduce the resistance of the retaining plate 4 to the retaining clip 6, so that the snap portion 11 can be pushed to the upper surface of the retaining plate 4 smoothly, and then the snap portion 11 can be snapped into the groove 10.

Referring to FIGS. 1-2, a connecting plate 13 arranged horizontally is fixed between the two brackets 3, so that the table plate 1 can be removed when it is damaged without destroying the brackets 3. The connecting plate 13 is configured as an inverted U-shaped structure and the upper surface of the connecting plate 13 is higher than the upper surface of the bracket 3. The center of the connecting plate 13 is formed with a screw hole 14 for a screw to pass through and be fixed to the table plate 1, so that the screw can be passed through the screw hole 14 by the operator, and then be fixed to the table plate 1 to further fix the bracket 3 to the lower surface of the table plate 1. When the table plate 1 is damaged, the bracket 3 can be removed smoothly from the table plate 1 by removing the screw, so that the bracket 3 and the retaining plate 4 can be recycled and resources can be saved.

In some embodiments, the implementation principle of this embodiment is as follows: when the control box 5 needs to be installed to the table plate 1 by an operator, the retaining clip 6 on the control box 5 can be firstly moved towards the direction of the retaining plate 4 to place the two retaining clips 6 into a cavity in the center of the retaining plate 4. Then, the control box 5 is moved, so that the receiving recess 61 is moved towards the direction of the edge of the retaining plate 4, the snap portion 11 is slid into the groove 10, and in turn the four retaining clips 6 are snap connected with the retaining plate 4 at four edges, thereby installing the control box 5 on the lower surface of the table plate 1 stably. The installing process is convenient, time-saving and effort-saving.

The above are the preferred embodiments of the present application, which are not intended to limit the protection scope of the present application. Therefore, all equivalent changes made according to the structure, shape and principle of the present application fall in the protection scope of the present application.

What is claimed is:

1. A height-adjustable table, comprising a table plate, with a table leg being fixedly connected to a side surface of the table plate, wherein, two brackets are arranged oppositely on the side surface of the table plate, a retaining plate is fixedly connected at two ends to opposite inner sides of the two brackets, respectively, a control box is provided, a retaining clip is fixedly connected to the control box, the retaining clip is detachably connected to the retaining plate, the retaining clip is defined with a receiving recess for receiving the retaining plate, the retaining clip is configured to be L-shaped, one end of the retaining clip is fixedly connected to a side of the control box away from a front face of the control box, and a second end of the retaining clip is a free end.

2. The height-adjustable table according to claim 1, wherein, a limiting plate is fixedly connected to an upper surface of the control box, and a sidewall of the limiting plate is attached to an edge of the retaining plate.

3. The height-adjustable table according to claim 2, wherein, a reinforcing block is fixedly connected to the control box, and a sidewall of the reinforcing block is fixedly connected to a second sidewall of the limiting plate away from the retaining plate.

4. The height-adjustable table according to claim 3, wherein, a reinforcing rib is fixedly connected to a side of the retaining clip away from the retaining plate.

5. The height-adjustable table according to claim 2, wherein, a buffer portion is fixedly connected to the sidewall of the limiting plate towards the retaining plate.

6. The height-adjustable table according to claim 3, wherein, a rectangular frame is formed inside the retaining plate; there are at least two retaining clips; and the at least two retaining clips are snap connected with the retaining plate at an inner edge and an outer edge of the retaining plate, respectively.

7. The height-adjustable table according to claim 5, wherein, the buffer portion is made of rubber.

8. The height-adjustable table according to claim 5, wherein, a side of a free end of the retaining clip towards the retaining plate is configured as an inclined plane for guiding the retaining clip to be snap connected with the retaining plate.

9. The height-adjustable table according to claim 1, wherein, a side of the retaining plate close to the receiving recess is formed with a groove, and the second end of the retaining clip is formed with a snap portion configured to be snapped into the groove.

10. The height-adjustable table according to claim 9, wherein, the snap portion is configured to be semicircular arc shaped.

11. The height-adjustable table according to claim 1, wherein, a connecting plate is fixedly connected between the two brackets, and the connecting plate is formed with a screw hole for a screw to pass through and be fixed to the table plate.

12. A height-adjustable table, comprising a table plate, with a table leg being fixedly connected to a side surface of the table plate, wherein, two brackets are arranged oppositely on the side surface of the table plate, a retaining plate is fixedly connected at two ends to opposite inner sides of the two brackets, respectively, a control box is provided, a retaining clip is fixedly connected to the control box, the retaining clip is detachably connected to the retaining plate, a limiting plate is fixedly connected to an upper surface of the control box, a sidewall of the limiting plate is attached to an edge of the retaining plate, a reinforcing block is fixedly connected to the control box, and a sidewall of the reinforcing block is fixedly connected to a second sidewall of the limiting plate away from the retaining plate.

13. The height-adjustable table according to claim 12, wherein, a reinforcing rib is fixedly connected to a side of the retaining clip away from the retaining plate.

14. The height-adjustable table according to claim 12, wherein, a rectangular frame is formed inside the retaining plate; there are at least two retaining clips; and the at least two retaining clips are snap connected with the retaining plate at an inner edge and an outer edge of the retaining plate, respectively.

15. A height-adjustable table, comprising a table plate, with a table leg being fixedly connected to a side surface of the table plate, wherein, two brackets are arranged oppositely on the side surface of the table plate, a retaining plate is fixedly connected at two ends to opposite inner sides of the two brackets, respectively, a control box is provided, a retaining clip is fixedly connected to the control box, the retaining clip is detachably connected to the retaining plate, a limiting plate is fixedly connected to an upper surface of the control box, a sidewall of the limiting plate is attached to an edge of the retaining plate, a buffer portion is fixedly connected to the sidewall of the limiting plate towards the retaining plate; and a side of a free end of the retaining clip towards the retaining plate is configured as an inclined plane for guiding the retaining clip to be snap connected with the retaining plate.

* * * * *